US005297494A

United States Patent [19]

Kim et al.

[11] Patent Number: 5,297,494

[45] Date of Patent: Mar. 29, 1994

[54] INCINERATOR FOR BURNING WASTE

[76] Inventors: Jae B. Kim, 1-10, Songworl-dong, Joong-ku, Inchun; Jang H. Kim, Na-dong 105, Saehan Apt., Yonghyun-dong, Nam-Ku, Inchun, both of Rep. of Korea

[21] Appl. No.: 996,181

[22] Filed: Dec. 23, 1992

[30] Foreign Application Priority Data

Mar. 2, 1992 [KR] Rep. of Korea ..... 92-3441

[51] Int. Cl.[5] ..... F23B 7/00

[52] U.S. Cl. ..... 110/234; 110/246; 432/103

[58] Field of Search ..... 110/246, 210, 203, 234; 432/103, 105

[56] References Cited

U.S. PATENT DOCUMENTS

| | | | |
|---|---|---|---|
| 4,862,813 | 9/1989 | Levin et al. | 432/246 |
| 4,870,912 | 10/1989 | Lee | 432/246 |
| 4,889,058 | 12/1989 | Yang et al. | 432/214 |
| 4,889,059 | 12/1986 | Whitlow et al. | 432/103 |
| 4,957,433 | 9/1990 | Swisher, Jr. | 432/103 |
| 4,961,390 | 10/1990 | Whitlow et al. | 432/246 |
| 4,961,391 | 10/1990 | Mok et al. | 432/246 |
| 5,103,745 | 4/1992 | Harloff | 432/103 |

FOREIGN PATENT DOCUMENTS

| | | |
|---|---|---|
| 79-1379 | 8/1979 | Rep. of Korea . |
| 90-12040 | 8/1990 | Rep. of Korea . |
| 92-18403 | 10/1992 | Rep. of Korea . |

*Primary Examiner*—Henry C. Yuen
*Attorney, Agent, or Firm*—Ladas & Parry

[57] ABSTRACT

A combustible waste incinerator with a tubular furnace defining a cavity with a first opening for receiving said waste and a second opening and an interior and an exterior surface is disclosed. A burner unit is positioned at the second opening of the cavity for producing an intense flame in the cavity sufficient to burn the combustible waste therein. A water pipe and an air pipe are spirally coiled along the interior surface of the cavity for dissipating heat formed and supplying air to the cavity to promote combustion. The water pipe and the air supply pipe are disposed on the interior surface of the cavity such that a spiral channel is formed from the first opening to the second opening of the cavity. A cylindrical wire screen is disposed between the water and air supply pipes and the cavity to permit at least a portion of the waste to pass from the cavity into the spiral channel. A means for rotating the furnace about its longitudinal axis enables at least a portion of the waste in the tubular furnace to tumble within the cavity so as to be directly exposed to the flame produced by the burner to dry and breakup waste so an additional portion of the waste passes from the cavity into the spiral channel to be moved in the channel away from the first opening.

16 Claims, 5 Drawing Sheets

INCINERATOR FOR BURNING WASTE

BACKGROUND OF THE INVENTION

1. Field of the Invention

The present invention relates to an incinerator for burning and more particularly to an incinerator capable of burning a household waste, for example, briquette ashes which includes combustible coal and residue of foodstuffs, or an industrial waste in a high efficiency.

2. Information Disclosure Statement

Conventional incinerators have been used mainly for burning combustible waste which has been separately collected. However, such incinerators are unable to adequately burn waste where the waste has a high moisture content. Furthermore, conventional incinerators do not achieve complete burning of the waste, even though such waste includes only combustible waste. Thus, conventional incinerators only reduce the residue after burning to 1/10 of the waste.

Typically, the residue after burning is solidified and then packed in a vinyl package and buried in the ground.

There are various conventional incinerator structures. For example, a rotary furnace type incinerator is disclosed in Korea Utility Model Publication No. 79-1379 and an incinerator for burning refuse is disclosed in Korea Utility Model Publication No. 80-5070. Also, the present inventors have proposed a method of and a device for burning waste in Korea Patent Application Nos. 89-606 and 91-4119.

The incinerator disclosed in Korea Utility Model Publication No. 79-1379 has no conveying means for moving the waste to be burned toward the flame. In this case, the rotary furnace itself is inclined so that the heat in the furnace tends to be discharged out of the waste input port. As a result, it is difficult to achieve complete burning of the waste in this incinerator.

On the other hand, in the incinerator disclosed in Korea Utility Model Publication No. 80-5070, waste is dropped into a burning furnace via a spiral member disposed in a rotary kiln and then burned over a grate. The rotary kiln for conveying refuse and the burning furnace forms an angle of 90° degrees therebetween. Due to this arrangement, the remaining heat to be used for perfectly burning refuse and rising over the burning furnace enters the rotary kiln ant an angle of 90° degrees, thereby causing the force of heat to be weakened. As a result, this incinerator does not dry the waste at the waste input port.

Korea Patent application Nos. 89-606 and 91-4119 filed in the name of the present inventors provide improvements over the above mentioned devices. The present invention is an improvement over their previous devices.

SUMMARY OF THE INVENTION

The combustible waste incinerator of the present invention is defined by the claims with a specific embodiment shown in the attached drawings. For the purpose of summarizing the invention, this invention relates a waste incinerator comprising a tubular furnace 1 which defines a cavity 40 with a first opening 41 and a second opening 43 and an interior 44 and an exterior 45 surface. A burner unit 15 is positioned at the second opening of the cavity for producing an intense flame in the cavity sufficient in use to burn the combustible waste therein. A water pipe 7 is spirally coiled along the interior surface of the cavity for dissipating heat formed in use in the furnace. An air supply pipe 9 is spirally coiled along the interior surface of the cavity and with the air supply pipe having a plurality of apertures 9*a* formed therein for supplying air to the cavity of the furnace to promote in use combustion of the combustible waste in the cavity. The water pipe and the air supply pipe are disposed on the interior surface of the cavity in a manner such that a spiral channel 9*d* is formed from the first opening to the second opening of the cavity. A cylindrical wire screen is disposed between the water and air supply pipes and the cavity. A means, such as an electric motor, for rotating the furnace along its longitudinal axis is employed to enable in use at least a portion of the waste in the tubular furnace to tumble within the cavity in order to reduce large clumps of waste in size and dry the waste with at least a portion of the waste falling through the cylindrical wire screen and into the spiral channel for movement in the channel away from the first opening. Upon further rotation of the furnace at least a portion of the combustible waste further tumbles within the cavity and is further reduced in size, further dried and burned such that at least a further portion present in the cavity falls through the screen and into the channel for movement toward the second opening. Upon further rotation the combustible waste is further burned such that upon arriving at the second opening the combustible waste is completely burned.

The cavity may be divided into a drying section for receiving and drying the combustible waste, a primary burning section for substantially burning the combustible waste and a secondary burning section for completing the burning of the combustible waste and discharging ash generated by burning the combustible waste. The drying section, the primary burning section and the secondary burning section each further include a diameter, with the diameter of the secondary burning section being greater than the diameter of the primary burning section, and with the diameter of the primary burning section being greater than the diameter of the drying section.

The cylindrical wire screen preferably includes a mesh size which decreases in size from the first opening to the second opening. In the incinerator of the present invention the cylindrical wire screen most preferably includes a mesh size with the drying section having a large mesh size relative to the mesh size of the primary burning section, and with the mesh size of the primary burning section having a mesh size larger than the mesh size of the secondary burning section.

The incinerator of the present invention preferably includes a disc pivotally mounted at the terminal end 43*a* of the second opening 43 which pivots to an open position to enable the removal of incombustible lumps from the cavity. The disc includes a flame passing opening 17 formed therein which permits the flame generated by the burner to pass through the disc and into the cavity. The flame passing opening 17 of the pivotable disc further includes a wall with a plurality of threads formed therein in a reverse manner relative to the spiral channel 9*d* such that in use matter entering the opening during rotation of the tubular furnace is moved back into the cavity upon engagement with the reverse cut threads.

A plurality of uniformly spaced protrusion members are preferably positioned in the cavity in a spiral manner to aid in churning the waste in the cavity and in moving or forcing the waste toward the terminal end of the second opening of the cavity. The plurality of uniformly spaced protrusion members may be positioned along the spiral channel.

Therefore, an object of the invention is to provide an incinerator capable of burning miscellaneous waste including waste with a high moisture content as well as other combustible waste, without the need to divide the waste prior to burning.

Another object of the invention is to provide an incinerator capable of producing an ash residue by burning waste containing a large content of briquette ashes which is a substitute for porous pearlite material thereby eliminating the problem of burying the incinerator residue usually encountered after burning the waste.

Preferably, the cavity of the furnace is tapered toward the first opening. That is, the diameter of the second opening is greater than the diameter of the first opening, and most preferably the cavity is tapered in steps.

In accordance with the present invention, these objects can be accomplished by providing an incinerator for burning waste which comprises a waste input unit, a burner unit having at least one burner and a tubular rotary furnace having a tubular shell of a double cylindrical plate construction with a spaced inner and outer plates. The tubular furnace defines a cavity with a first opening and a second opening and an interior and an exterior surface. The first opening is placed adjacent to the waste input unit and the second opening is placed adjacent to the burner unit. The tubular rotary furnace includes a drying section positioned near the waste input unit, a primary burning section and a secondary burning section positioned near the burner unit. The primary burning section is positioned between the drying section and the secondary burning section. Thermal insulation is interposed between the inner and outer plates. A water pipe is radially disposed in the shell of the rotary furnace with the spiral water pipe extending the length of the rotary furnace. An air supply pipe with a plurality of air outlet apertures formed therein is radially disposed in the shell of the rotary furnace with the spiral air supply pipe extending the length of the rotary furnace. The water pipe and the air supply pipe are disposed on the interior surface of the cavity such that a spiral channel is formed from the first opening to the second opening of the cavity. The spiral channel provides a spiral path for feeding the waste and ashes produced by the burning of the waste. A cylindrical wire screen is disposed between the cavity and the air and water pipes. The cylindrical wire screen extends the length of the rotary furnace. A plurality of uniformly spaced protrusion members are used with a protrusion member placed at each turn of the air supply pipe. The protrusion members aid in churning the waste in the cavity and driving the waste toward the second opening of the cavity. A rotatable disc is mounted proximate the second opening of the cavity of the rotary furnace and includes a fire passing opening formed therein. A means for pivoting the disc, so as to form a gap between the disc and the wall of the cavity at the second opening of the cavity through which non-combustible matter can be removed from the furnace.

BRIEF DESCRIPTION OF THE DRAWINGS

Other objects and aspects of the invention will become apparent from the following description of the embodiments with reference to the accompanying drawings in which.

DETAILED DESCRIPTION OF THE PREFERRED EMBODIMENT

FIGS. 1–9 illustrate the incinerator according to the present invention.

Figure 1:
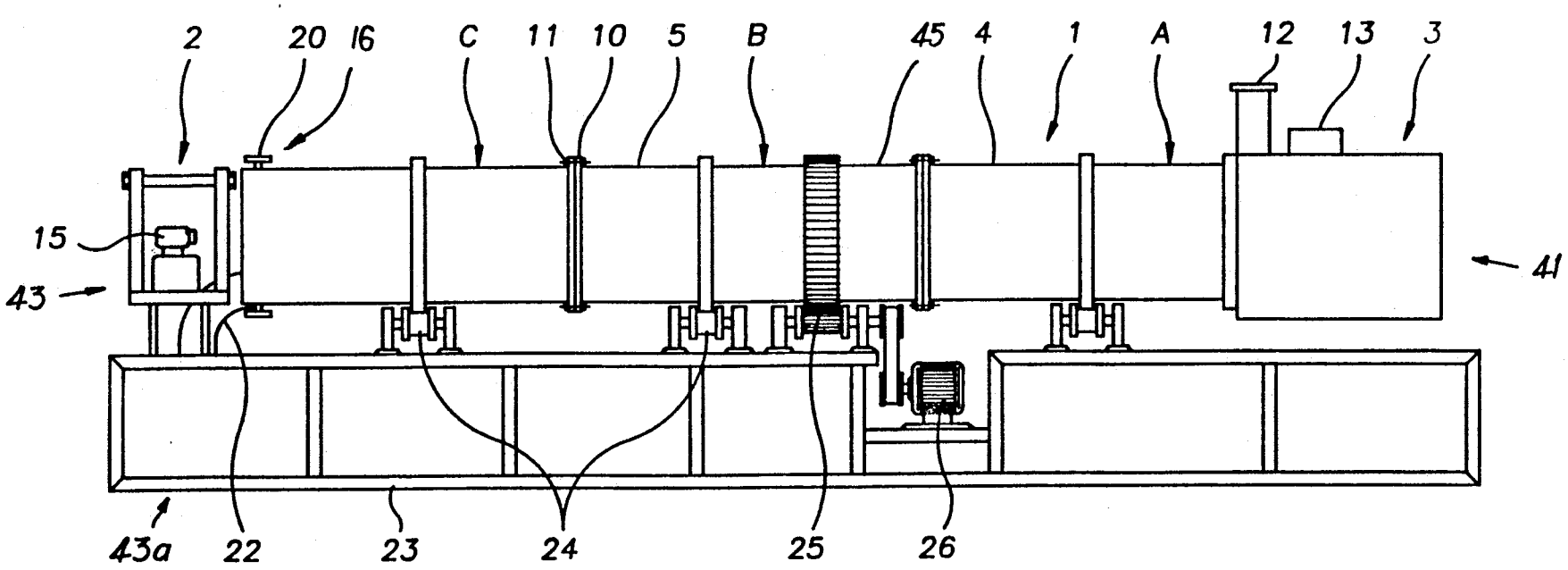
FIG. 1 is a schematic side view of the incinerator in accordance with the present invention.
Figure 2:
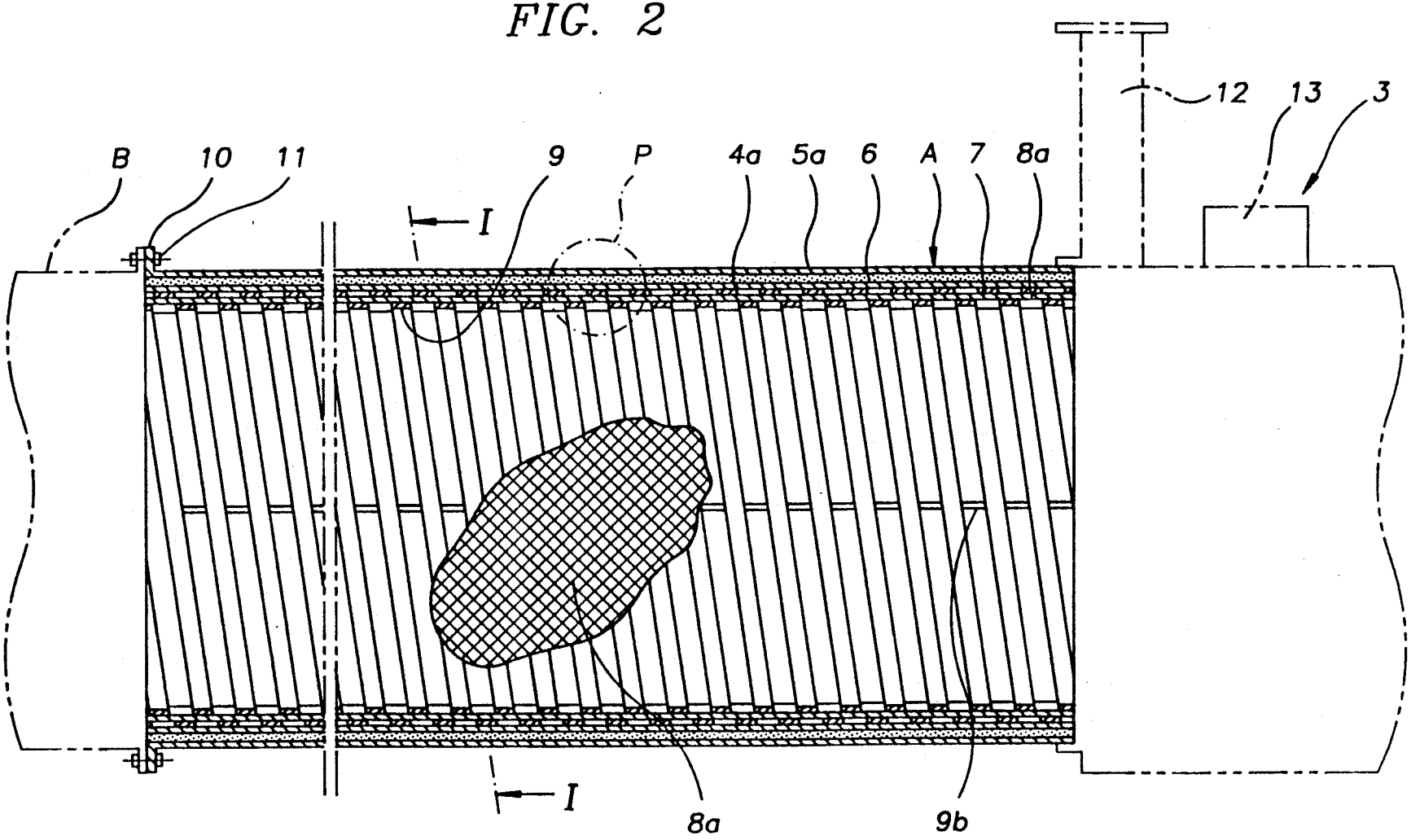
FIG. 2 is a sectional view of the drying section of the rotary furnace of the incinerator of FIG. 1.
Figure 3:
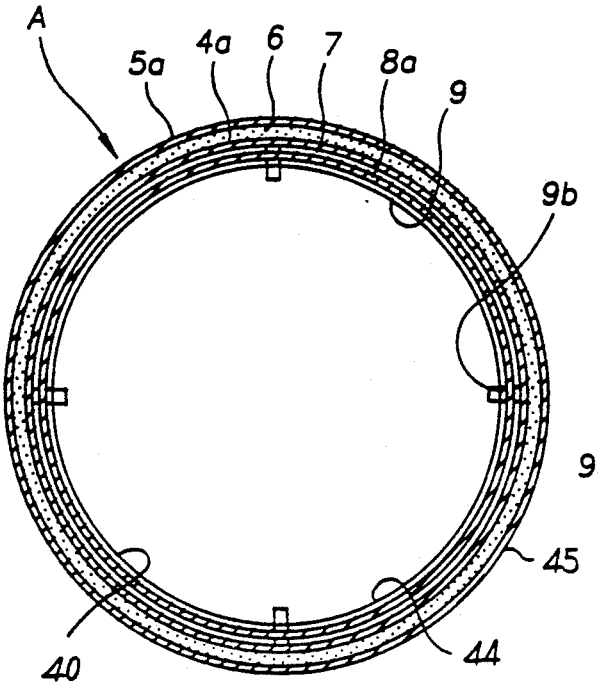
FIG. 3 is a cross-sectional view taken along line I—I of FIG. 2.
Figure 4:
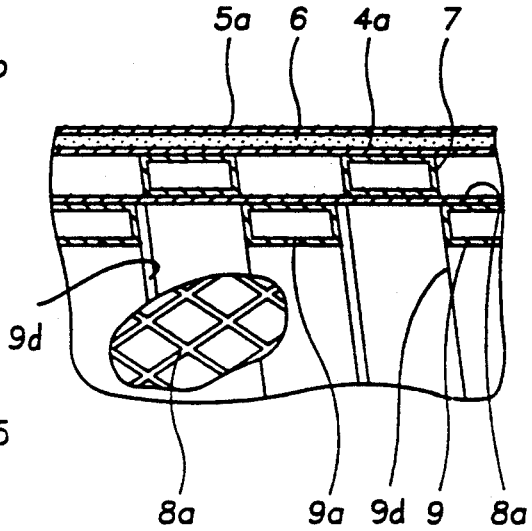
FIG. 4 is an enlarged view of part P of FIG. 2.
Figure 8:
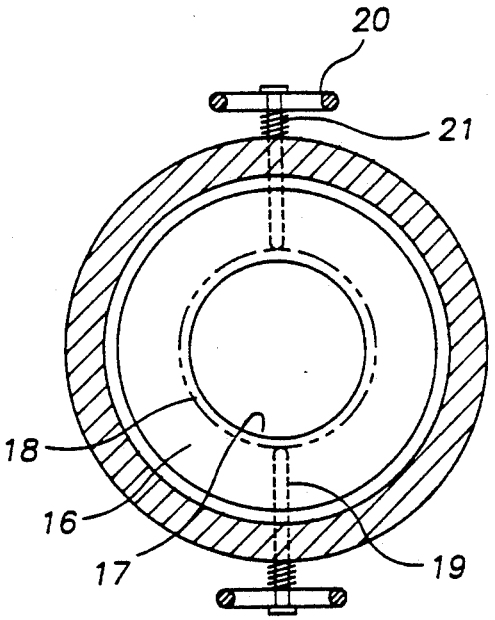
FIG. 8 is a cross-sectional view taken along the line B—B of FIG. 5, showing a condition that a rotatable disc is at its normal position.
Figure 9:
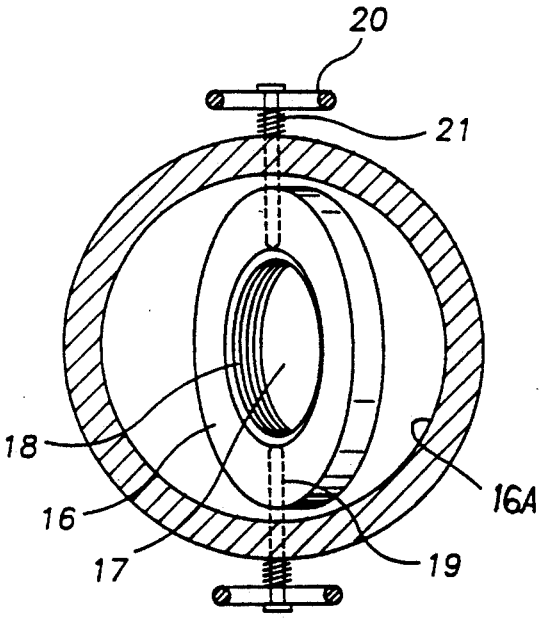
FIG. 9 is a cross-sectional view similar to FIG. 8, showing a condition that the rotatable disc has been rotated about 30° degrees.

FIG. 1 illustrates the incinerator which comprises a rotating tubular furnace 1, a burner unit 2 and a waste input unit 3. The rotary furnace 1 defines a cavity 40 with a first opening 41 and a second opening 43 and an interior 44 and an exterior 45 surface. The function of the furnace can be divided into three sections, a drying section A which is disposed near the waste input unit 3, a primary burning section B and a secondary burning section C which is disposed near the burner unit 2. Preferably, the primary burning section has a diameter larger than that of the drying section A, but smaller than that of the secondary burning section C.

The rotary furnace 1 is preferably constructed as a shell of a double cylindrical plate construction which comprises inner and outer plates. The shell has three shell portions corresponding to the sections A to C and comprising inner plates 4*a* to 4*c* and outer plates 5*a* to 5*c*, respectively as to each section. The inner and outer plates 4*a* and 5*a* of the drying section A are made of a stainless steel plate. On the other hand, the inner and outer plates 4*b* and 5*b* of the primary burning section C are made of a stainless steel plate and refractory bricks, respectively. The inner and outer plates 4*c* and 5*c* of the secondary burning section C are made of the same materials as those of the inner and outer plates 4*b* and 5*b*. Thermal insulation 6 is interposed between each inner plate and each corresponding outer plate.

The water and air pipes 7, 9 are coiled within the cavity along the interior wall of the cavity. That is, the spiral water pipe 7 and the air supply pipe 9 are disposed within the cavity in a manner to form a spiral channel 9*d* for moving waste and ashes which drops through the wire screens 8*a*, 8*b* and 8*c* toward the second opening. The spiral water pipe further serves to cool the wire screens and to generate hot water during the burning of waste by pumping water therethrough. Each cylindrical wire screen, 8*a*, 8*b* and 8*c* corresponding to the sections A to C of the rotary furnace 1, respectively, is disposed between the water and air supply pipes and the cavity itself.

The size of the mesh decreases as one moves from the first opening to the second opening of the cavity. Thus, wire screens 8*a*, 8*b* and 8*c*, have mesh sizes of 4 cm×4 cm, 2 cm×2 cm and 1 cm×1 cm, respectively. Radially inward of the wire screens 8*a*, 8*b* and 8*c* is disposed the spiral air supply pipe 9 having a plurality of air outlet apertures 9*a* formed therein.

The air supply pipe 9 supplies air in the rotary furnace 1, to promote the burning of waste in the rotary furnace 1. The water pipe and the air supply pipe are disposed on the interior surface of the cavity such that a spiral channel 9*d* is formed from the first opening to the second opening of the cavity which provides a path along within which the waste and ashes move.

The air supply pipe 9 preferably includes a plurality of uniformly spaced protrusion members 9*b* to aid in churning the waste within the cavity as the furnace rotates.

The shell portions of rotary furnace 1 which correspond to sections A, B and C have flanges 10 at each end to enable the sections to be joined together by a plurality of bolts 11.

Figure 6:
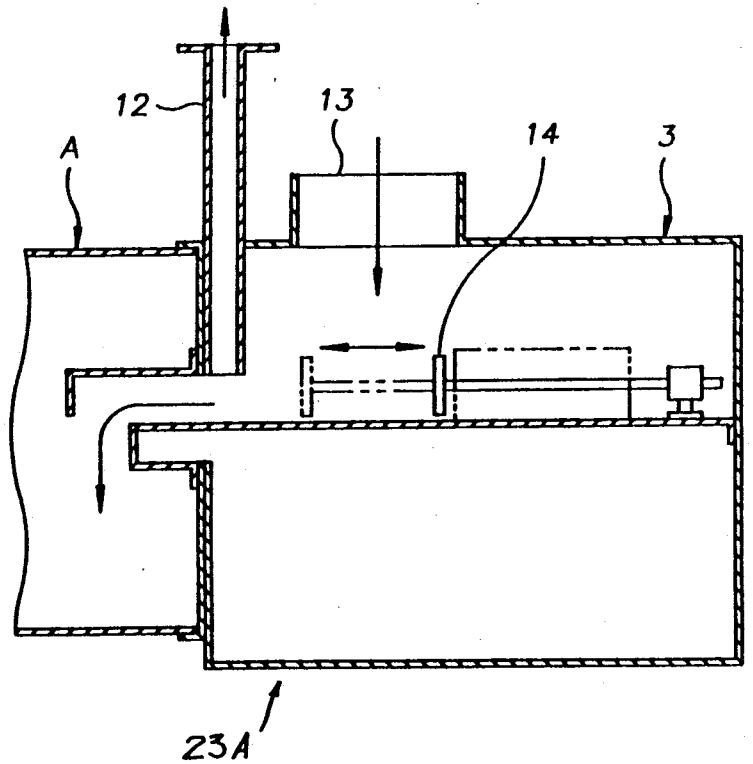
FIG. 6 is a sectional view of the waste input unit of the incinerator.

FIG. 6 illustrates the waste input unit 3. The waste input unit 3 has an exhaust gas outlet 12 and a waste input port 13 at its upper portion. The waste input unit 3 also includes a feeding plate 14 for pushing waste dropped from the waste input port 13. The feeding plate 14 can be moved in either a forward direction, i.e. toward the first opening of the cavity or in a rearward direction, i.e. away from the first opening of the cavity, by well-known means, such as a hydraulic ram (not shown).

The burner unit 2 which is positioned proximate the second opening of the cavity, i.e. proximate the secondary burning section C of the rotary furnace 1, has a pair of burners 15. Where the water content of the waste to be burned is low, only one of the burners 15 may be operated so as to reduce the consumption of fuel while attaining the required dryness for burning.

Figure 5:
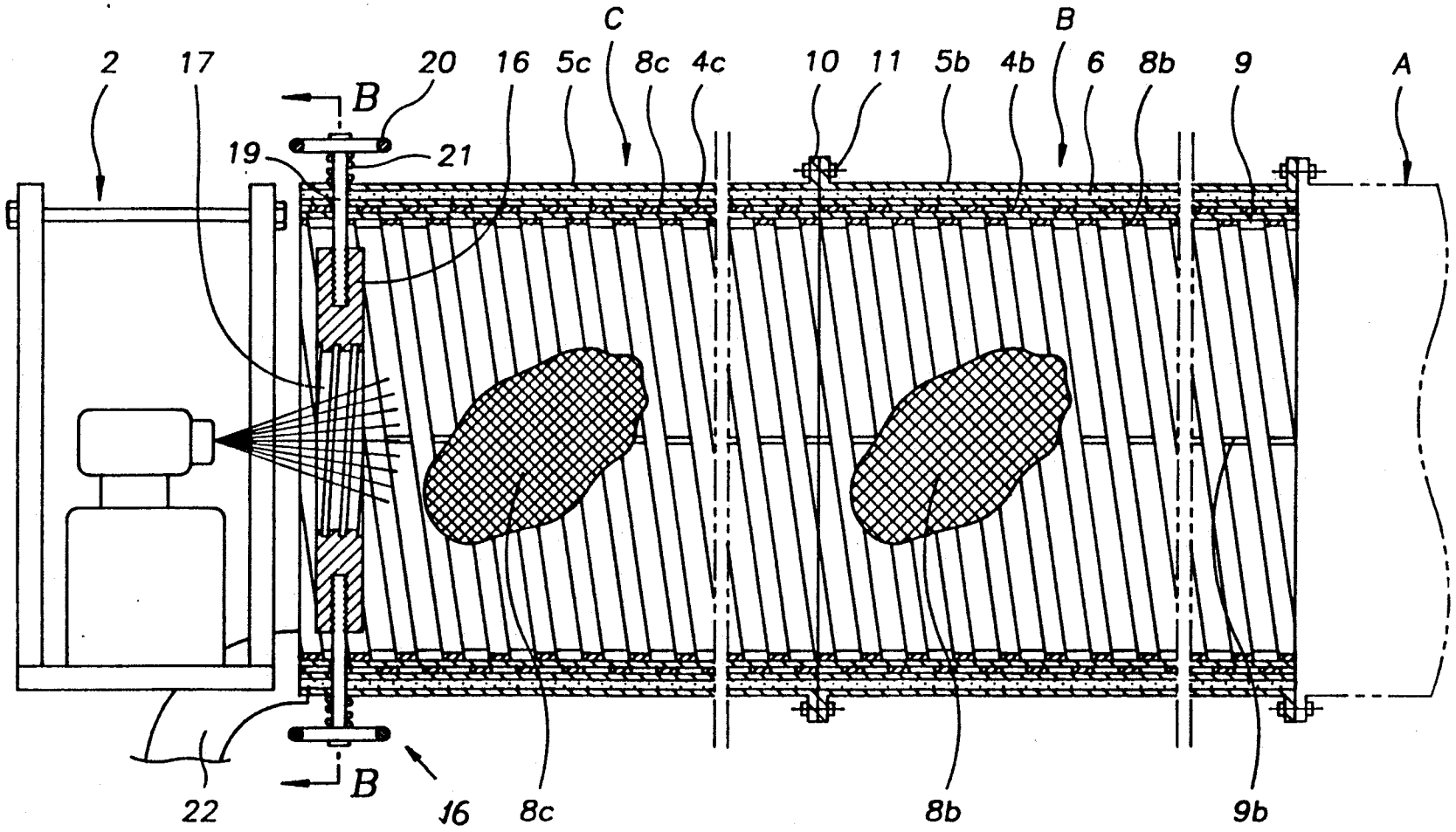
FIG. 5 is a cross-sectional view similar to FIG. 3, showing primary and secondary sections of the rotary furnace.
Figure 7:
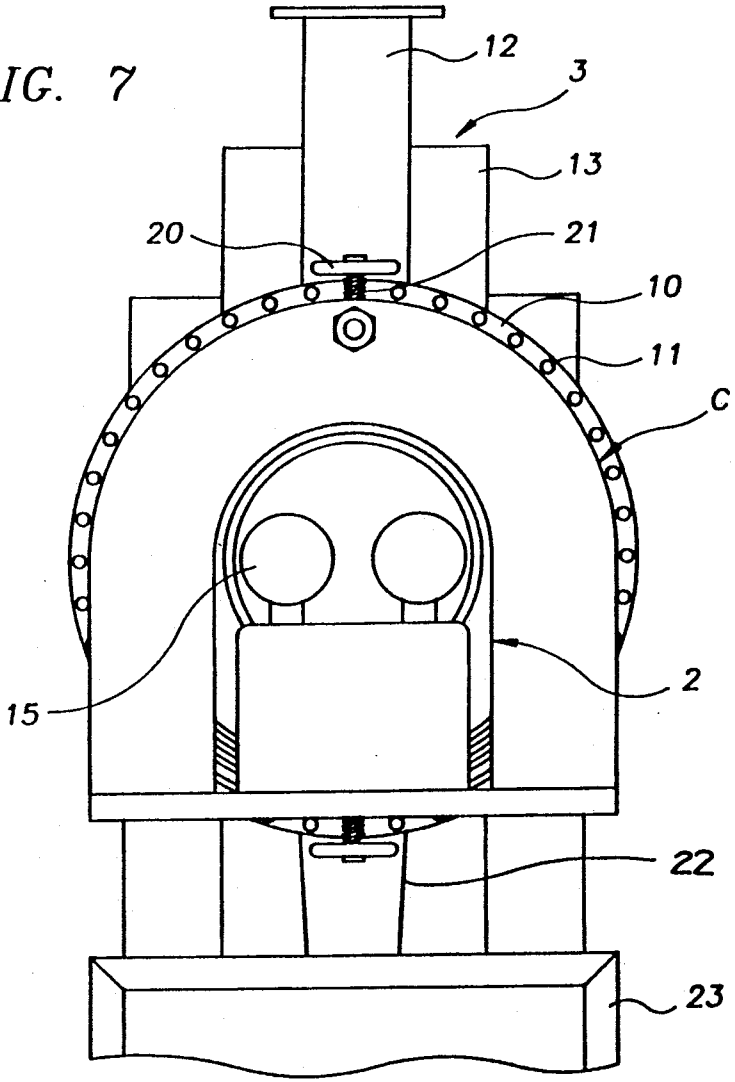
FIG. 7 is an end view of the incinerator.

At the second opening adjacent to the burner unit 2, the secondary burning section C includes a pivotable disc 16 which pivots to an open position to enable the removal of incombustible lumps from the rotary furnace 1, as shown in FIG. 5. The pivotable disc 16 includes a flame passing opening 17 formed therein and preferably with threads 18 formed on the wall of the flame passing opening in a reverse manner relative to the spiral direction of the air supply pipe 7. The pivotable disc 16 is pivotally mounted to the downstream end of the rotary furnace 1, by means of a pair of handles 20 oppositely disposed relative to each other at the outer surface of rotary furnace 1. Each handle 20 has a handle shaft 19 extending inward from the outer surface of the rotary furnace 1 and threadedly coupled with the pivotable disc 16. With this construction, the disc 16 can be rotated by the rotation of handles 20, to form an opening, together with the rotary furnace 1. A compression spring 21 is interposed between each handle 20 and the outer wall surface of rotary furnace 1, so as to prevent the disc 16 from inadvertently pivoting until is manually handled.

As best illustrated in FIG. 1, the ashes collecting member 22 receives ashes from the furnace 1 and channels the ashes away from the furnace 1. The furnace 1 is supported by a support 23 on which are a number of roller members 24 each of which cooperate with a ring gear 25 to guide the furnace as it is rotated by a motor 26.

Operation of the incinerator having the above-mentioned construction according to the present invention is described below.

As the furnace 1 rotates at a predetermined rate, for example, at about 2 RPM, waste poured through the waste input unit 3 into the incinerator is fed into the cavity of the furnace 1, section A, by the feeding plate 145 where the water content of the waste is lowered in order to enhance the combustibility of the combustible waste.

Since the air supply and water pipes 9, 7 are spirally arranged inward relative to the wire screens 8*a*, 8*b* and 8*c*, along the length of the rotary furnace 1 and form a spiral channel, the waste in the rotary furnace 1 is fed from the drying section A to the primary burning section B, along the spiral channel. In the primary burning section B, large lumps of waste dried more or less at the drying section A are burned at the wire screen 8*b*, while small lumps are burned in the spiral channel 9*d*. During the burning, the waste, including any lumps of waste, is continuously pushed upward by the protrusion members 9*b* secured to the air supply pipe 9 which results in the churning of the waste and causing it to fall onto the lower portion of the primary burning section B. Accordingly, the efficiency of drying and burning the waste is vastly improved. Also, the constant churning caused by the rotation of the furnace and aided by the protrusion members 9*b* results the pulverization of the briquette ashes and glass pieces contained in the waste. Such effects are also present in the drying section A and the secondary burning section C. The combustion of the waste in the primary burning section B is carried out by the heat generated by the burners 15, by the burning waste, by the heat radiated from the wire screen 8*b* and the inner plate 4*b* and by the excess air provided by the air supply pipe 9 which promotes combustion.

The waste which is substantially burned or reduced to ash at the primary burning section B is then fed to the secondary burning section C along the spiral channel 9*d* so that any portion which is not burned yet is completely burned at the secondary burning section C. Ashes produced by burning move to the channel by passing through the mesh of the wire screen 8*c* and then are ultimately spirally fed to the ashes correcting member 22 along the spiral path.

At this time, lumps of incombustible ironware, and other non-combustibles, collect at the downstream end of the secondary burning section C, i.e. at the second opening of the cavity. When the amount of collected incombustible lumps becomes too large, the lumps are removed from the incinerator. The removal of collected incombustible lumps is achieved by stopping the rotation of rotary furnace 1 and pivoting the disc 16 to form a gap through which the lumps can be removed. The disc may be pivoted to an open position by manually turning one of the handles 20 of pivotable disc 16 about 30° degrees. By pivoting the disc 16, the gap is formed between the disc 16 and the downstream end of the secondary burning section C. Through the gap, the incombustible lumps can be removed from the cavity of the rotary furnace 1. By virtue of the compression spring 21 interposed between each handle 20 and the outer wall surface of the rotary furnace 1, the disc 16 cannot open or pivot during rotation until the handle is manually manipulated.

The combustible lumps, which are slowly fed toward the fire passing opening 17 of the pivotal disc 16, reach the pivotal disc they are forced into the flame passing through the opening 17 during the rotation of the furnace. Here the combustible lumps are prevented from being discharged out of the rotary furnace 1 through the fire passing opening 17, by virtue of the force of flame at the fire passing opening 17 and, optionally, by the formation of threads 18 formed on the aperture wall of the fire passing opening 17 which are cut in a direction reverse to the direction of the rotation of the furnace.

As mentioned above, the wire screens for sections 8*a*, 8*b* and 8*c*, respectively, gradually decrease in mesh size from the drying section A to the secondary burning section C in the rotary furnace 1. The drying section A has the largest mesh size to permit waste lumps having a small size to drop through the wire screen 8*a* and thereby separate small waste lumps from large sized lumps. This separation of waste lumps in terms of size makes it possible to improve the drying efficiency. On the other hand, the primary burning section B has a screen mesh size smaller than that of the drying section A, so as to burn most of the dried waste lumps fed from the drying section A. Since the secondary burning section C has the smallest mesh size, it can burn even combustibles fed from the primary burning section B, thereby enabling the amount of the final residue to be minimized.

In accordance with the present invention, the waste is dried and then burned by the heat from the burners 15. In case of burning combustible matter which is a single object with a large volume, such as waste tires, it can be put into the rotary furnace 1 through the fire passing opening 17 of the pivotable disc 16. In this case the burner unit 1 must be moved away from the rotary furnace 1 to permit such waste to be placed in the furnace. The heat generated upon burning such combustible waste may be utilized to obtain energy via the water pipes.

The composition of the residue after burning in the incinerator of the present invention includes a very small amount of ashes because of the complete burning of the combustible waste, a small amount of broken glass and ceramic ware, grains of reburned briquette ashes and large incombustibles such as ironware, cans and the like. The reburned briquette ashes pulverize during rotation and movement in the rotary furnace 1, so as to be in a powder form. The powder may be melted at a temperature of about 1,000° degrees C., together with other small waste, so that they are fused together, to form a porous structure. This porous structure is attached with ashes resulting from the burning of other waste and thus becomes more strong and bulky.

After separating from incombustible ironware, such as cans, the porous material can be utilized as a substitute for pearlite because of its porous structure. For example, it can be used as a material for improving the quality of the soil, a light structural frame material, a filtering material and etc.

As apparent from the above description, the present invention provides an incinerator capable of eliminating the difficulties in handling waste due to the shortage of filled-in land. The incinerator can burn and to permit the deposit a great amount of waste in a short time and at low cost, thereby aiding in preventing environmental pollution. The incinerator also achieves complete burning of the briquette ashes and thus has an effect of providing a useful by-product.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A combustible waste incinerator comprising:

a tubular furnace defining a cavity with a first opening for receiving said waste and a second opening and an interior and an exterior surface;

a burner unit positioned at said second opening of said cavity for producing an intense flame in said cavity sufficient to burn said combustible waste therein;

a water pipe spirally coiled along said interior surface of said cavity for dissipating heat formed in use in said furnace;

an air supply pipe spirally coiled along said interior surface of said cavity and with said air supply pipe having a plurality of apertures formed therein for supplying air to said cavity of said furnace to promote in use combustion therein;

said water pipe and said air supply pipe being disposed on said interior surface of said cavity such that a spiral channel is formed from said first opening to said second opening of said cavity;

a cylindrical wire screen disposed between said water and air supply pipes and said cavity to permit at least a portion of said waste to pass from said cavity into said spiral channel; and, means for rotating said furnace about its longitudinal axis such that in use at least a portion of said waste in said tubular furnace tumbles within said cavity so as to be directly exposed to said flame produced by said burner thereby drying and breaking up said waste such that at least an additional portion of said waste passes from said cavity into said spiral channel to be moved in said channel away from said first opening, and upon further rotation of said furnace an additional portion of said combustible waste further tumbles within said cavity so as to be directly exposed to said flame produced by said burner thereby becoming further reduced in size, dried and burned such that a further portion of said waste passes from said cavity into said spiral channel for movement toward said second opening, and upon further rotation said waste further tumbles and burns such that upon arriving at said second opening said combustible waste is completely burned.

2. The incinerator of claim 1 wherein said cavity is divided into a drying section for receiving and drying said combustible waste, a primary burning section for substantially burning said combustible waste and a secondary burning section for completely burning said combustible waste and discharging ash generated by burning said combustible waste.

3. The incinerator of claim 2 wherein said drying section, said primary burning section and said secondary burning section each further include a diameter, with said diameter of said secondary burning section being greater than said diameter of said primary burning section, and with said diameter of said primary burning section being greater than said diameter of said drying section.

4. The incinerator of claim 1 wherein said cylindrical wire screen further includes a mesh size which decreases in size from said first opening for receiving said waste to said second opening.

5. The incinerator of claim 4 wherein said cylindrical wire screen further includes a mesh size with said drying section having a large mesh size relative to said mesh size of said primary burning section, and with said mesh size of said primary burning section having a mesh size larger than said mesh size of said secondary burning section.

6. The incinerator of claim 1 wherein said second opening of said cavity further includes a disc pivotally mounted thereat which pivots to an open position to enable the removal of incombustible lumps from said cavity; and said disc further including a flame passing opening 17 formed therein for enabling said flame generated by said burner to pass through said disc and into said cavity.

7. The incinerator of claim 6 wherein said flame passing opening 17 of said pivotable disc further includes a wall with a plurality of threads formed therein in a reverse manner relative to the spiral channel such that in use matter entering said opening during rotation of said tubular furnace is moved back into said cavity by said threads.

8. The incinerator of claim 1 further including a plurality of uniformly spaced protrusion members are positioned in said cavity in a spiral manner to aid in churning said waste in said cavity and in forcing said waste toward said second opening of said cavity.

9. The incinerator of claim 8 where said plurality of uniformly spaced protrusion members are positioned along said spiral channel.

10. A combustible waste incinerator comprising: a tubular furnace defining a cavity with a first opening for receiving said waste and a second opening and an interior and an exterior surface with said cavity being divided into a drying section for receiving and drying said combustible waste, a primary burning section for substantially burning said combustible waste and a secondary burning section for completely burning said combustible waste and discharging ash generated by burning said combustible waste;

said drying section, said primary burning section and said secondary burning section each further including a diameter, with said diameter of said secondary burning section being greater than said diameter of said primary burning section, and with said diameter of said primary burning section being greater than said diameter of said drying section;

a burner unit positioned at said second opening of said cavity for producing an intense flame in said cavity sufficient to burn said combustible waste therein;

a water pipe spirally coiled along said interior surface of said cavity for dissipating heat formed in use in said furnace;

an air supply pipe spirally coiled along said interior surface of said cavity and with said air supply pipe having a plurality of apertures formed therein for supplying air to said cavity of said furnace to promote in use combustion therein;

said water pipe and said air supply pipe being disposed on said interior surface of said cavity such that a spiral channel is formed from said first opening to said second opening of said cavity;

a cylindrical wire screen disposed between said water and air supply pipes and said cavity to permit at least a portion of said waste to pass from said cavity into said spiral channel; and, said cylindrical wire screen further includes a mesh size which decreases in size from said first opening of said cavity to said second opening of said cavity;

said second opening of said cavity further includes a disc pivotally mounted thereat which pivots to an open position to enable the removal of incombustible lumps from said cavity;

said disc further including a flame passing opening 17 formed therein for enabling said flame generated by said burner to pass through said disc and into said cavity;

means for rotating said furnace about its longitudinal axis such that in use at least a portion of said waste in said tubular furnace tumbles within said cavity so as to be directly exposed to said flame produced by said burner thereby drying and breaking up said waste such that at least an additional portion of said waste passes from said cavity into said spiral channel to be moved in said channel away from said first opening, and upon further rotation of said furnace an additional portion of said combustible waste further tumbles within said cavity so as to be directly exposed to said flame produced by said burner thereby becoming further reduced in size, dried and burned such that a further portion of said waste passes from said cavity into said spiral channel for movement toward said second opening, and upon further rotation said waste further tumbles and burns such that upon arriving at said second opening said combustible waste is completely burned.

11. The incinerator of claim 10 wherein said cylindrical wire screen further includes a mesh size with said drying section having a large mesh size relative to said mesh size of said primary burning section, and with said mesh size of said primary burning section having a mesh size larger than said mesh size of said secondary burning section.

12. The incinerator of claim 10 wherein said flame wall with a plurality of threads formed therein in a reverse manner relative to the spiral channel such that in use matter entering said opening during rotation of said tubular furnace is moved back into said cavity by said threads.

13. The incinerator of claim 10 further including a spiral manner in said cavity to aid in churning said waste in said cavity and in forcing said waste toward said second opening of said cavity.

14. The incinerator of claim 13 where said plurality of uniformly spaced protrusion members are positioned along said spiral channel.

15. The incinerator of claim 1 further including a waste input unit positioned at said first opening;

an exhaust gas outlet and a waste input port being formed in said waste input unit;

a feeding plate positioned in said waste input unit for pushing waste dropped from said waste input port through said first opening and into said cavity of said furnace.

16. The incinerator of claim 10 further including a waste input unit positioned at said first opening;

an exhaust gas outlet and a waste input port formed in said waste input unit;

a feeding plate positioned in said waste input unit for pushing waste dropped from said waste input port through said first opening and into said cavity of said furnace.

* * * * *